US008215509B2

(12) United States Patent
Kuboi et al.

(10) Patent No.: US 8,215,509 B2
(45) Date of Patent: Jul. 10, 2012

(54) SOFT PET BOTTLE WITH A RIGID TOP AND BOTTOM PORTION

(75) Inventors: Satoshi Kuboi, Tokyo (JP); Hideki Takeuchi, Sakaki-Machi (JP)

(73) Assignee: The Coca-Cola Company, Atlanta, GA (US)

( * ) Notice: Subject to any disclaimer, the term of this patent is extended or adjusted under 35 U.S.C. 154(b) by 372 days.

(21) Appl. No.: 12/056,363

(22) Filed: Mar. 27, 2008

(65) Prior Publication Data

US 2009/0242504 A1 Oct. 1, 2009

(51) Int. Cl.
*B65D 90/02* (2006.01)
*B65D 6/00* (2006.01)

(52) U.S. Cl. ..... 215/381; 215/900; 215/382; 220/666; 220/669; 206/218

(58) Field of Classification Search ..... 220/666, 220/669, 671, 667; 215/381, 579, 379, 382, 215/371, 387, 900, 42; 206/217, 218; 224/586
See application file for complete search history.

(56) References Cited

U.S. PATENT DOCUMENTS

| | | | | |
|---|---|---|---|---|
| 5,255,808 | A * | 10/1993 | Tobler | 220/6 |
| 5,310,068 | A * | 5/1994 | Saghri | 215/386 |
| 6,223,932 | B1 * | 5/2001 | Usui | 220/666 |
| 6,334,543 | B1 * | 1/2002 | Abbondandolo | 220/666 |
| 7,513,378 | B2 * | 4/2009 | Mori et al. | 215/381 |
| 7,530,475 | B2 * | 5/2009 | Ophardt | 222/94 |
| 2002/0104820 | A1 * | 8/2002 | Hong et al. | 215/381 |
| 2003/0168426 | A1 * | 9/2003 | Yourist | 215/382 |
| 2004/0211747 | A1 * | 10/2004 | Whitley | 215/382 |
| 2005/0017015 | A1 * | 1/2005 | Higuchi | 220/666 |
| 2008/0173652 | A1 * | 7/2008 | Chou | 220/592.17 |
| 2008/0210697 | A1 * | 9/2008 | Kessell et al. | 220/666 |
| 2009/0179440 | A1 * | 7/2009 | Saber | 294/1.3 |
| 2009/0308867 | A1 * | 12/2009 | Lal | 220/8 |
| 2010/0016825 | A1 * | 1/2010 | Graf et al. | 604/408 |

FOREIGN PATENT DOCUMENTS

| | | | |
|---|---|---|---|
| JP | H06-006215 | U | 1/1994 |
| JP | H08-244747 | A | 9/1996 |
| JP | H10-230919 | A | 9/1998 |
| JP | H11-070929 | A | 3/1999 |
| JP | 2000-355324 | A | 12/2000 |
| JP | 2004-029970 | A | 1/2004 |
| JP | 2006-219157 | A | 8/2006 |

* cited by examiner

*Primary Examiner* — Mickey Yu
*Assistant Examiner* — Kareen Rush
(74) *Attorney, Agent, or Firm* — Parks IP Law LLC; Collen A. Beard, Esq.

(57) ABSTRACT

Disclosed herein is a plastic bottle suitable for vending from vending machines and for storing food or beverage products having comparatively high viscosities. A bottle is provided with a mouth, a flexible main unit having a tubular body section in fluid communication with the mouth, a base forming a bottom of the main unit and configured to support the bottle to stand upright, and a rigid portion located above the main unit and having greater traverse strength than said main unit. The mouth, main unit, and base define a retention space with a central axis. The rigid portion includes regions facing each other across from the central axis at the most distant position from the central axis. Moreover, the tubular body section of the main unit deforms into a substantially flat shape when an external force is applied in a transverse direction without the rigid portion undergoing plastic deformation.

18 Claims, 15 Drawing Sheets

SOFT PET BOTTLE WITH A RIGID TOP AND BOTTOM PORTION

TECHNICAL FIELD

The invention relates to plastic bottles suitable for storing and dispensing contents having a comparatively high viscosity, for example, a jelly beverage.

BACKGROUND

Generally, plastic bottles, for example, PET bottles, store products having comparatively low viscosities, for example, water, tea, carbonated beverages, juices, and the like. Bottles containing those low viscous fluids have been widely marketed and have been sold at retail stores and in automatic vending machines. However, plastic bottles containing products having comparatively high viscosities such as jelly beverages, which are squeezed to be dispensed for drinking, have not been marketed.

Plastic bottles that can be folded up after use for waste recovery and plastic bottles whose volume before filling can be temporarily reduced for efficient stacking and shipping have been available. For example, a plastic bottle can be formed with soft walls and rigid walls, alternating in the circumferential direction, so that sections of the shoulder, body, and base having soft walls would fold inward after use. (See Japanese Kokai Publications Hei-8-24474 and Hei-10-230919.)

Another container known as a spout-pouch container is suitable for containing a jelly beverage. For example, one spout pouch container has a bag-like container main unit having a flexible sheet that has a spout of rigid resin heat sealed thereto. (See Japanese Kokai Publication Hei-2004-29970.) In use, the consumer pushes the flexible sheet to squeeze out the jelly beverage from the spout. In addition, the spout pouch container has been designed so as to stand erect in cooler cases found in stores. (See Japanese Kokai Publication Hei-2006-219157.)

The sale of spout pouch containers, however, has been limited to in-store sales, and they have not been sold in automatic vending machines (hereinafter "vending machines"). Indeed, vending machines are designed to hold aluminum cans or rigid plastic bottles that are strong enough to withstand horizontal placement. In contrast, the main unit of the spout pouch container would droop if stacked in vending machines.

The insertion of spout pouch containers in aluminum or rigid plastic tubes in order to hold spout pouch containers in vending machines has been considered. Such a method, however, has poor operational efficiency and is costly.

In addition, the use of plastic bottles to store comparatively high viscous products like jelly beverages and for vending in vending machines has been considered but has been limited by the bottle configuration. If the bottle is too strong, it is difficult, if not impossible, to dispense the jelly beverage. Conversely, if the bottle strength is reduced to allow a jelly beverage to be dispensed by squeezing, the strength becomes insufficient for stacking in vending machines, and it becomes difficult to open the cap.

Accordingly, there remains a need to provide a plastic bottle that is suitable for vending by vending machines and for storing and dispensing products having comparatively high viscosities.

SUMMARY

A bottle is provided with a mouth, a flexible main unit having a tubular body section and in fluid communication with the mouth, a base forming a bottom of the main unit and configured to support the bottle to stand upright, and a rigid portion located above the main unit and having greater traverse strength than the main unit. The mouth, main unit, and base define a retention space with a central axis. The rigid portion includes regions facing each other across from the central axis at the most distant position from the central axis. Moreover, the tubular body section of the main unit deforms into a substantially flat shape when an external force is applied in a transverse direction without the rigid portion undergoing plastic deformation. In one aspect, the tubular body section is a cylindrical body section.

It is to be understood that both the foregoing general description and the following detailed description are exemplary and explanatory only and are not restrictive of the invention, as claimed.

DESCRIPTION OF THE EMBODIMENTS

Figure 1:
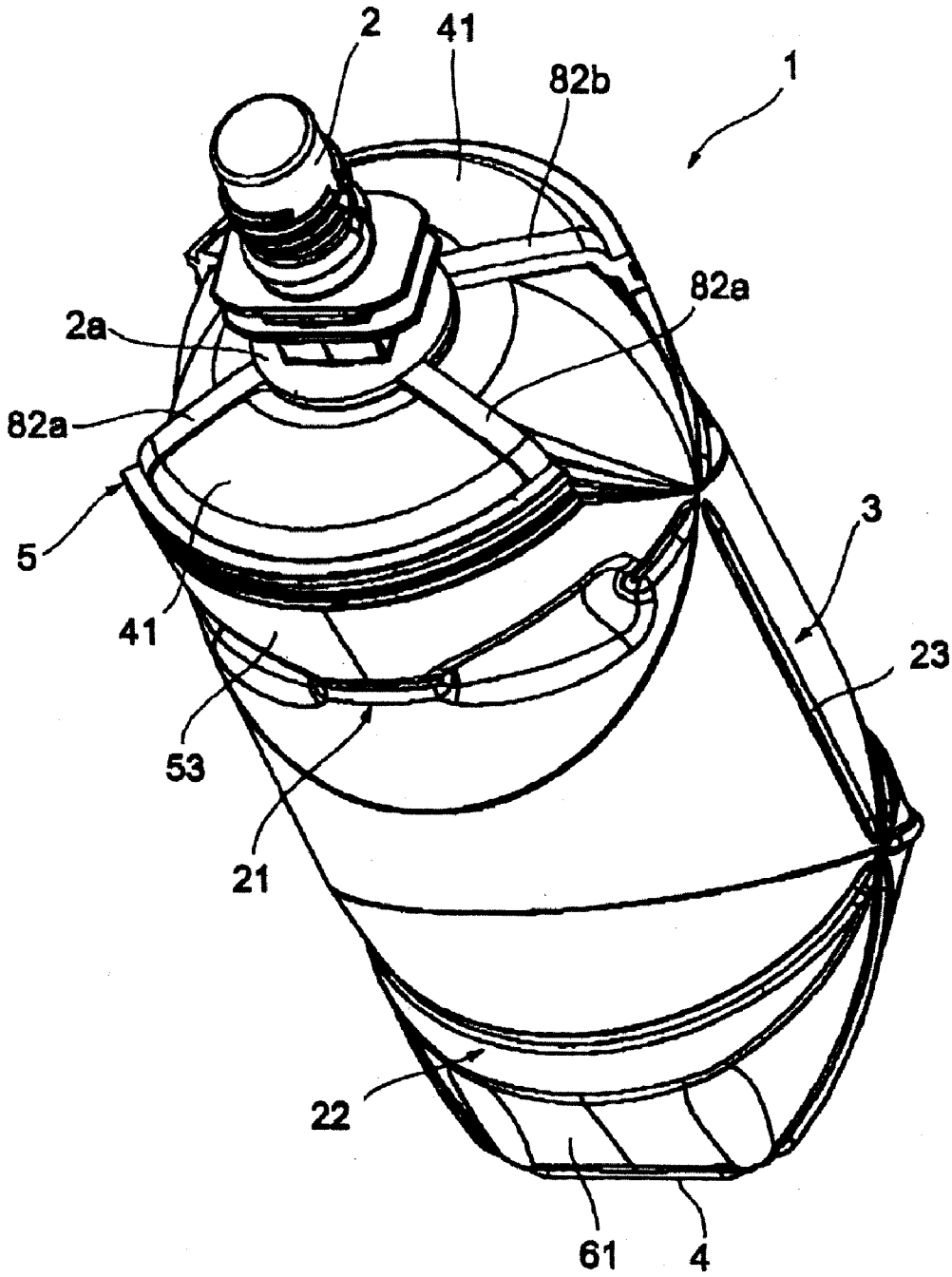
FIG. 1 depicts a perspective view of a plastic bottle according to one embodiment of the invention disclosed herein.

Disclosed herein are plastic bottles suitable for dispensing by vending machines. Moreover, the plastic bottles are configured to contain and dispense a product such as a viscous food or beverage.

In an embodiment disclosed herein, a bottle is provided with a mouth, a flexible main unit having a tubular body section and in fluid communication with the mouth, a base forming a bottom of the main unit and configured to support the bottle to stand upright, and a rigid portion located above the main unit and having greater traverse strength than the main unit. The mouth, main unit, and base define a retention space with a central axis. The rigid portion includes regions facing each other across from the central axis at the most distant position from the central axis. Moreover, the tubular body section of the main unit deforms into a substantially flat shape when an external force is applied in a transverse direction without the rigid portion undergoing plastic deformation.

In one embodiment, the plastic bottle is manufactured from a thermoplastic resin using various molding techniques. Suitable resins include at least one of polyethylene terephthalate (PET), polyethylene, and polypropylene. Prior to molding, the resin can be strengthened by biaxial stretching.

The mouth, main unit, base, and rigid portion can be integrally molded from a resin. The rigid portion and the main unit can be easily formed as a single molded article from the same resin. Suitable molding techniques include blow molding, injection blow molding, and two-axis stretch blow molding. For example, when the plastic bottle is formed using the injection stretch blow molding technique, the molding steps include injection molding of a preform into a predetermined shape, and stretching of the preform in the longitudinal direction by a stretching rod and in the transverse direction by air blowing.

Following molding and/or before filling the plastic bottle with a product, the plastic bottle can be washed and/or sterilized, for example, by heated water or chlorine sterilization techniques. After the plastic bottle is filled with the product, the mouth may be closed. In one embodiment, the mouth and a cap are sealed, providing a bottle in a sealed state. In one embodiment, the rigid portion is configured to allow the bottle to be pressed in a downward direction such that the cap opens.

The retention space defined by the main unit, mouth, and base can contain a comparatively high viscous product. Exemplary products for use with the plastic bottles disclosed herein include, without limitation, jelly beverages, liquid foods, miso, mayonnaise, and jams. Use of the plastic bottles disclosed herein is not restricted to comparatively high viscous products, however. The plastic bottles can alternatively contain comparatively low viscous products, for example, water, tea, fruit juices, alcohol, energy drinks, and carbonated beverages.

A consumer, food service provider, or machine may dispense the product from the plastic bottle by applying a transverse force, for example, squeezing, to the main unit. Depending on the amount of force applied, at least a portion of the product can be expelled through the mouth. Generally, a sufficient amount of force is slightly more than the force a consumer uses to hold a bottle in one hand. Specifically, the tubular body section of the main unit deforms to a flat or substantially flat shape by the application of force. Consequently, at least a portion of the product contained therein, even if exhibiting a comparatively high viscosity, can be expelled through the mouth.

Although the tubular body section deforms upon the application of a sufficient amount of force, the rigid portion is configured to maintain the traverse strength of the plastic bottle. Consequently, when plastic bottles, alone or in combination with other plastic bottles, are stacked horizontally, for example, during transit, in refrigerators or coolers, or in vending machines, the rigid portions support the plastic bottles such that deformation of the tubular body sections are inhibited. Furthermore, the bottles can be stored horizontally or at an angle between the horizontal and vertical planes in vending machines without deforming and without modifying the structure of existing vending machines.

Furthermore, the plastic bottles disclosed herein include at least two points of rigidity—the base and the rigid portion, the combination of which inhibits or reduces the incidence of deformation during shipment and storage.

Such strength of the bottles disclosed herein is useful for the consumer. For example, the rigid portion can be configured to provide sufficient resistance for removing a cap from the mouth. In an embodiment, the rigid portion is positioned proximate the mouth such that a cap can be opened with comparatively little twisting force.

In one aspect, the rigid portion includes a circumferential wall section. At least a portion of the circumferential wall section can contact the exterior of the upper wall of the main unit. For example, an inner wall of the circumferential wall section can make surface contact with an outer wall of an upper wall of the main unit. The force sustained by the circumferential wall section can be released toward the upper wall of the main unit. In particular, this structure is effective when the retention space is filled with a product proximate to the height of the upper wall.

Moreover, the rigid portion can include circumferential sections located at the most distant position from the central axis and facing with each other such that the central axis is interposed between them, and a connecting section above the upper wall of the main unit that connects the circumferential wall section with the mouth.

In one embodiment, the connecting section connects in strip shape with the mouth and at least two locations of the circumferential wall section. By using a strip shape, the connecting section connects the rigid portion to a portion of the upper wall rather than to the entire upper wall of the main unit. In so doing, the amount of materials and consequently, the costs associated with the connecting section can be reduced. Furthermore, since the connecting section connects with at least two locations of the circumferential wall section, the durability of the circumferential wall section relative to a transverse load can be enhanced in comparison to connection at only one location. In other embodiments, the connecting section connects with two locations, three locations, four locations, five locations, six locations or more of the circumferential wall section.

In one embodiment, the rigid portion can function as a discrete entity, independent of the main unit. As a consequence, deformation of the tubular body section to a substantially flat shape is not hindered. In another embodiment, the main unit includes a rigid portion, and the main unit is configured to deform in accordance with the embodiments disclosed herein.

In yet another embodiment, the connecting section can connect at least a part of the rigid portion to the main unit using at least two discontinuous sections. The circumferential wall section of the rigid portion can extend in the circumferential direction of the main unit such that it is discontinuous at two sections facing and enclosing the central axis. Four edges facing the discontinuous sections can be connected to the mouth by the connecting section. Use of discontinuous sections can reduce the amount of materials and consequently, the cost associated with contacting the rigid portion to the main unit in comparison to a ring-shaped connecting section.

In yet another embodiment, at least one concave rib extends in the elongate direction of the circumferential wall section. The traverse strength of the circumferential wall section is enhanced with the addition of at least one concave rib. In one embodiment, two or more concave ribs are distributed uniformly about the circumferential wall section. In another embodiment, two or more concave ribs are spaced apart at non-uniform distances.

In one aspect, the base can be more rigid than the main unit. Increasing the rigidity of the base relative to the main unit facilitates the ability of the plastic bottle to stand upright, which permits the plastic bottles disclosed herein to be stacked vertically in, for example, refrigerators or coolers.

In an embodiment, the main unit includes an upper body section extending upward from the tubular body section, a tapered shoulder connecting the upper body section with the mouth, and at least one step between the upper body section and the shoulder. The circumferential wall section of the rigid portion can be positioned at the at least one step, and the connecting section can be positioned at the shoulder. In an embodiment, the connecting section can connect the rigid portion to the main unit at the uppermost portion of the shoulder.

In a deformation configuration, that is, when the tubular body section deforms to a substantially flat shape, the inner wall of the upper body section can contact the inner wall of the shoulder. Product stored proximate to the upper body section and the shoulder can be easily squeezed out toward the mouth.

In another embodiment, the upper body section and the shoulder may take a shape to release the length that changes during deformation at a position away from the steps. The upper body section and the shoulder do not warp after deformation. The upper body section and the shoulder can extend in a traverse direction such that the extended portions are absorbed by a cavity of the upper body section.

In yet another embodiment, the tubular body section and the upper body section are configured to deform to a predetermined shape. A concave crease can be disposed between the upper body section and the tubular body section. In a further embodiment, at least a portion of a lower edge of the upper body section and at least a portion of an upper edge of the tubular body section slope inward toward the crease. The tubular body section and the upper body section can fold inward toward the concave crease when the tubular body section and the upper body section are pushed inward centering on the crease.

In an embodiment, the tubular body section includes a pair of second creases that mutually face and enclose the central axis. The pair of second creases may be positioned at two upper and lower parallel edges in a substantially flat shape. In this structure, the tubular body section can be induced to deform in a substantially flat shape since the region in the tubular body section is formed because of the two flat edges. The pair of second creases may be formed in convex shape such that the tubular body section would fold outward and deform in a substantially flat shape. In this structure, the tubular body section can be induced to assume a substantially flat shape. In addition, product adhering to the inner wall of the tubular body section can be squeezed outward compared to a tubular body section that deforms by inward folding.

The main unit can include a lower body section connecting the tubular body section to the base. The lower body section may deform to a different shape or at a different rate than the tubular body section.

The cross-sectional shape of the tubular body section can take the shape of any suitable or flexible shape. In one embodiment, the shape is cylindrical. In another embodiment, the shape is rectangular. In yet another embodiment, the shape is elliptical. In another embodiment, the shape is square. In another embodiment, the shape is polygonal.

Deformation of the tubular body section into a substantially flat shape can be plastic deformation. In other words, the tubular body section does not spontaneously revert to its original shape when the transverse force is removed following deformation.

Figure 3:
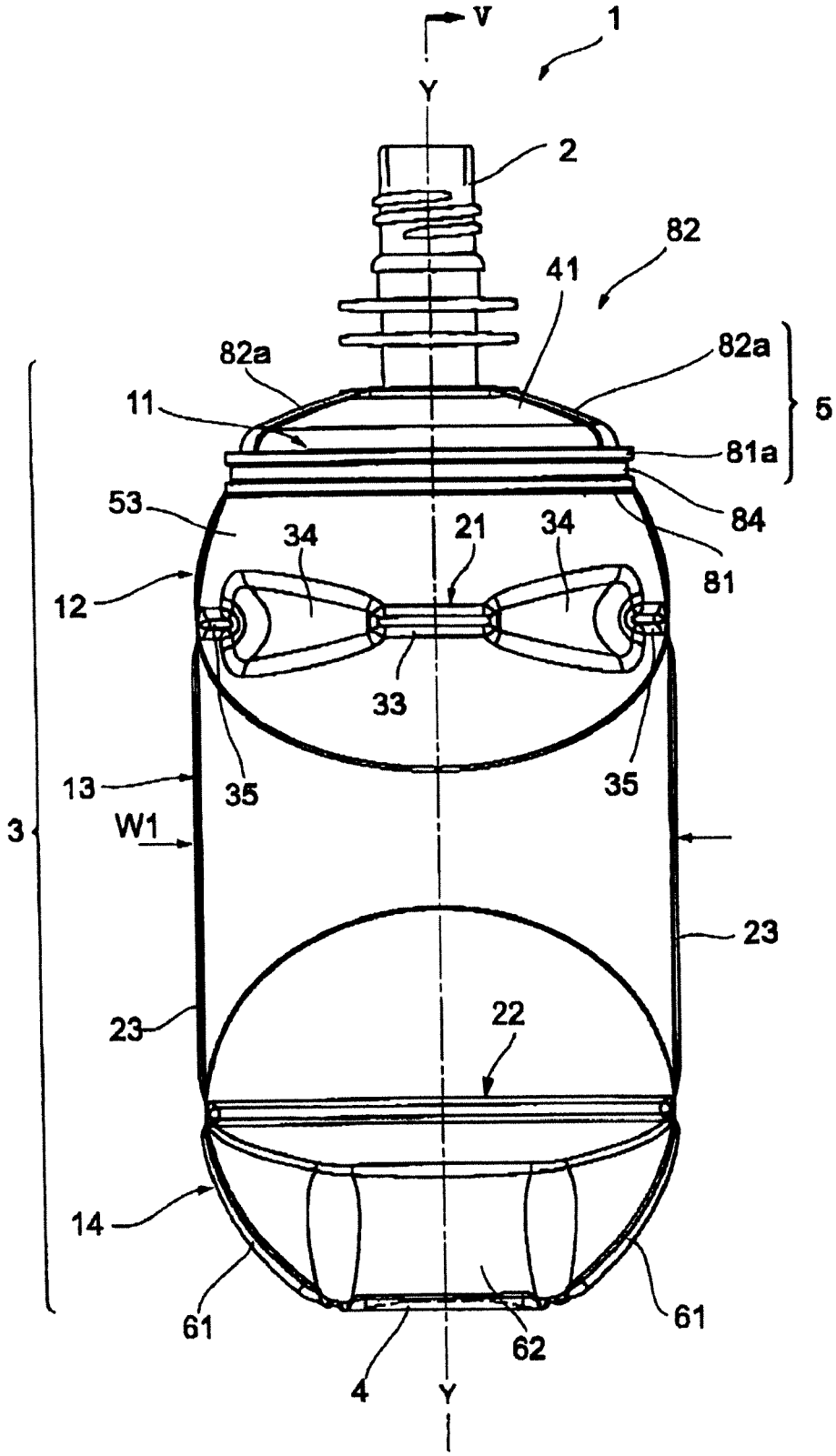
FIG. 3 depicts a front view of the plastic bottle of FIG. 1.
Figure 4:
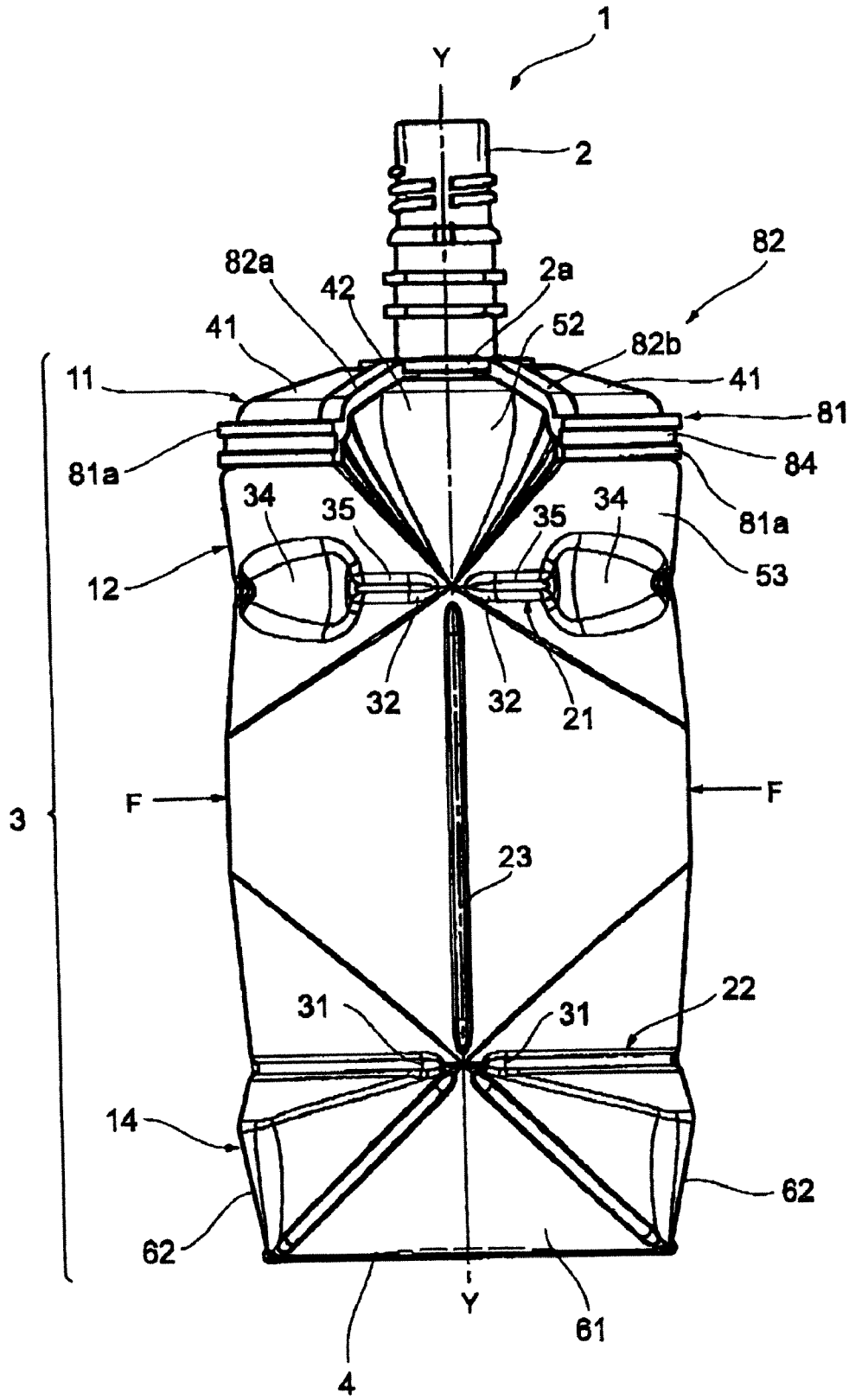
FIG. 4 depicts a side view from the transverse direction, shifted 90 degrees, of the plastic bottle of FIG. 1.

Reference will now be made in detail to various, exemplary embodiments illustrated in the accompanying drawings. Wherever possible, the same reference numbers will be used throughout the drawings to refer to the same or like parts. Terms used in the specification are defined as follows:

Terms that indicate direction, such as "upper" and "lower", are used when a plastic bottle 1 is set upright on a horizontal plane, the plane depicted in FIGS. 3 and 4. Accordingly, the interior of the paper plane in FIG. 3 is "up" and the foreground is "down". The upward/downward directions refer to the direction of Y-Y central axis of bottle 1. The transverse direction refers to the direction at right angles to the Y-Y central axis. Traverse strength refers to the strength relative to a load in the transverse direction. Height refers the length along the direction of the Y-Y central axis. Transverse cross-sectional shape refers the cross-sectional shape of bottle 1 on a plane at right angles to the Y-Y central axis. Circumferential direction refers to the direction along the contour of the transverse cross-sectional shape.

Figure 2:
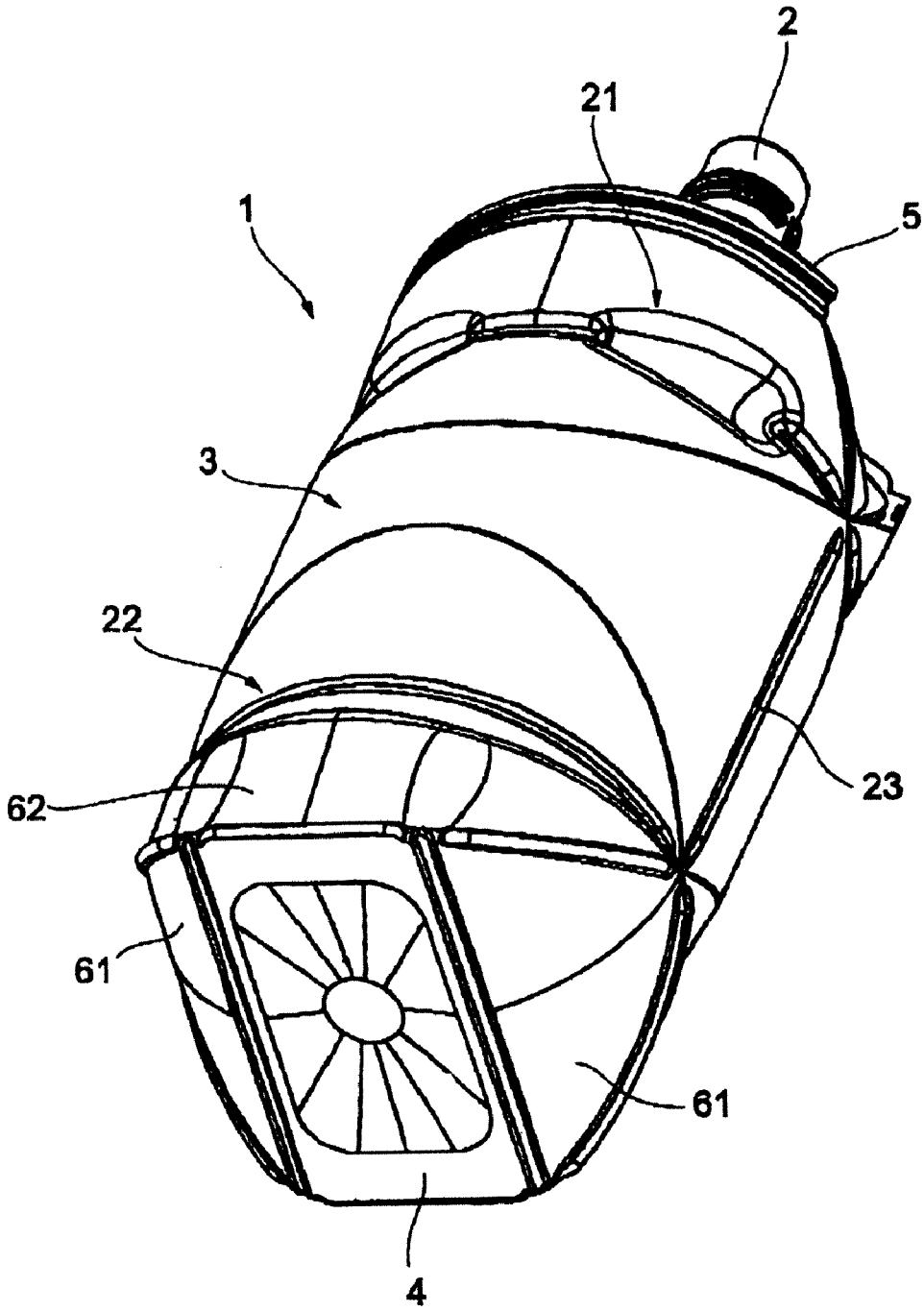
FIG. 2 depicts another perspective view of the plastic bottle of FIG. 1.

FIGS. 1 and 2 depict perspective views of a plastic bottle 1. Bottle 1 includes a mouth 2, a main unit 3, a base 4 forming a bottom of main unit 3, and a rigid portion 5 positioned above and outside of main unit 3. Mouth 2, main unit 3, base 4, and rigid portion 5 are molded integrally from the same resin. Mouth 2, main unit 3, and base 4 define a retention space that retains a product therein. Conversely, rigid portion 5 is exterior to the retention space, although continuous with lower edge 2*a* and main unit 3, as shown in FIG. 5, and does not directly contact the product therein.

Figure 5:
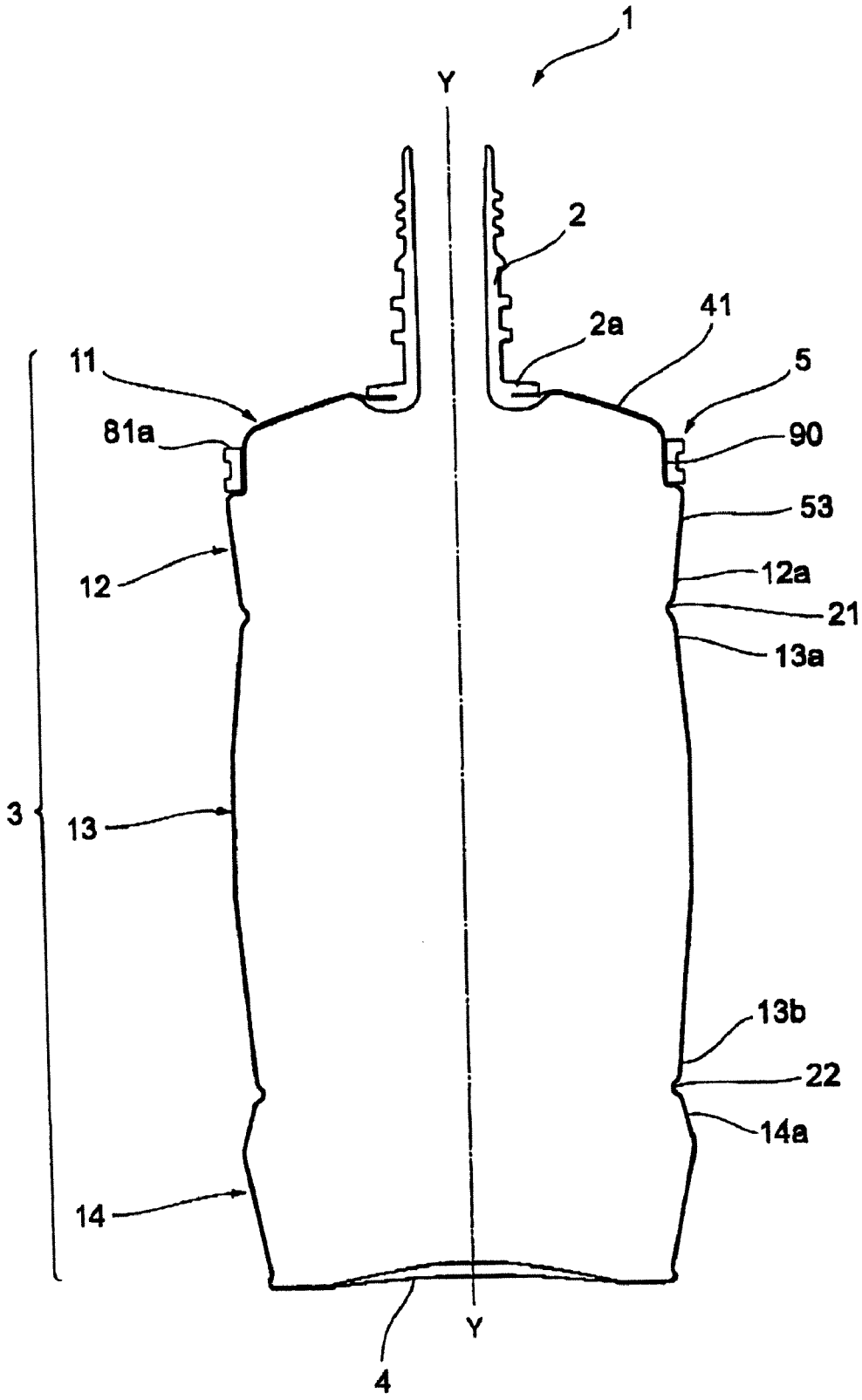
FIG. 5 depicts a longitudinal cross-sectional view cut along line V-V of the plastic bottle of FIG. 3.

Referring to FIG. 5, the thickness of the resin forming main unit 3 is less than the thickness of mouth 2 and rigid portion 5. While using the same resin, shape retention, hardness and strength are imparted to mouth 2 and rigid portion 5 while flexibility is imparted to main unit 3 by altering the thickness of the resin of each portion. The thickness of base 4 is about equal to that of main unit 3, but the rigidity is greater than that of main unit 3. Injection stretch blow molding can increase the hardness of base 4, relative to the hardness of mouth 2, main unit 3, and rigid portion 5.

Mouth 2 opens at the upper edge to function as an outgoing port for a product. The aperture of mouth 2 is opened and closed by a threaded cap. (Not shown.) Lower edge 2*a* of mouth 2 is molded in ring shape of predetermined thickness.

Figure 7:
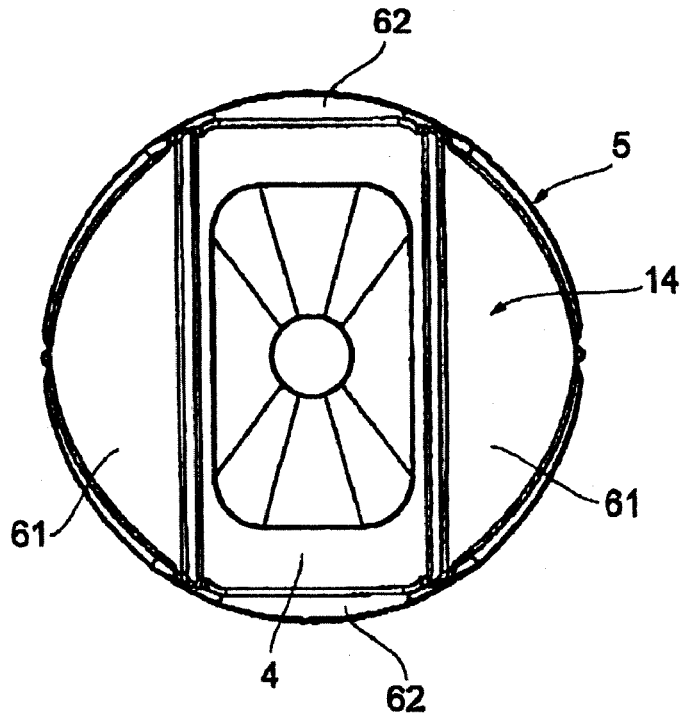
FIG. 7 depicts a bottom view of the plastic bottle of FIG. 3.

As illustrated in FIGS. 2, 5, and 7, base 4 is a flat region permitting bottle 1 to stand upright. Base 4 has a rectangular shape with axial symmetry viewed from the bottom. The center of base 4 swells slightly upward in comparison to the contour section, thereby raising the rigidity of base 4. Furthermore, the transverse cross-sectional shapes of main unit 3 and rigid portion 5 are formed with axial symmetry relative to the Y-Y central axis.

Main unit 3 is described with reference to FIG. 3-5. Main unit 3 includes a shoulder 11, an upper body section 12, a tubular section, or central body section 13, and a lower body section 14. Shoulder 11, upper body section 12, central body section 13 and lower body section 14 sequentially connect from the top along the Y-Y central axis. Shoulder 11 is a tapered region that is continuous with lower edge 2*a* of mouth 2 and upper body section 12. It forms an upper wall of main unit 3. Crease 21 is situated between upper body section 12 and central body section 13; crease 22 is situated between central body section 13 and lower body section 14. The regions of upper body section 12, central body section 13, and lower body section 14 are bounded by creases 21, 22. Furthermore, a pair of creases 23, 23 that extend in the upper/lower directions are formed in central body section 13.

Figure 8:
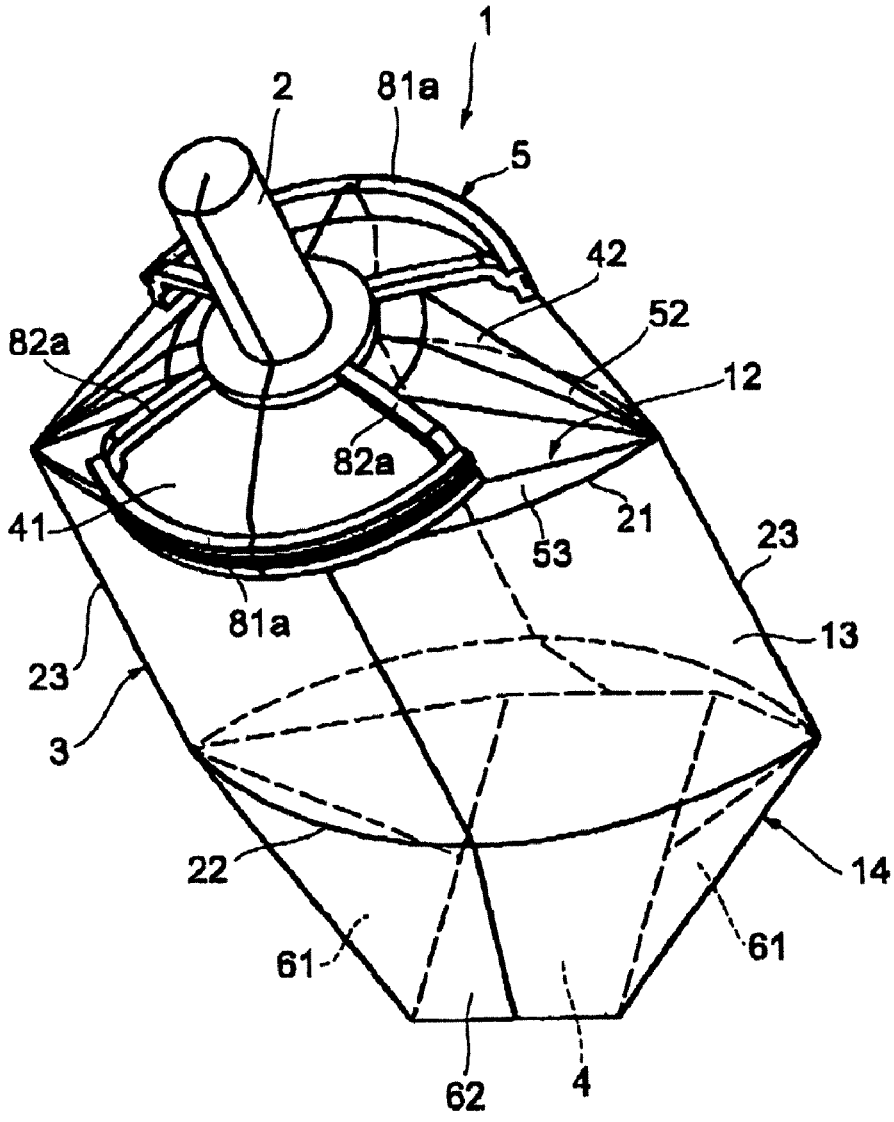
FIG. 8 depicts a perspective view of the deformation of the plastic bottle of FIG. 1 during deformation.
Figure 9:
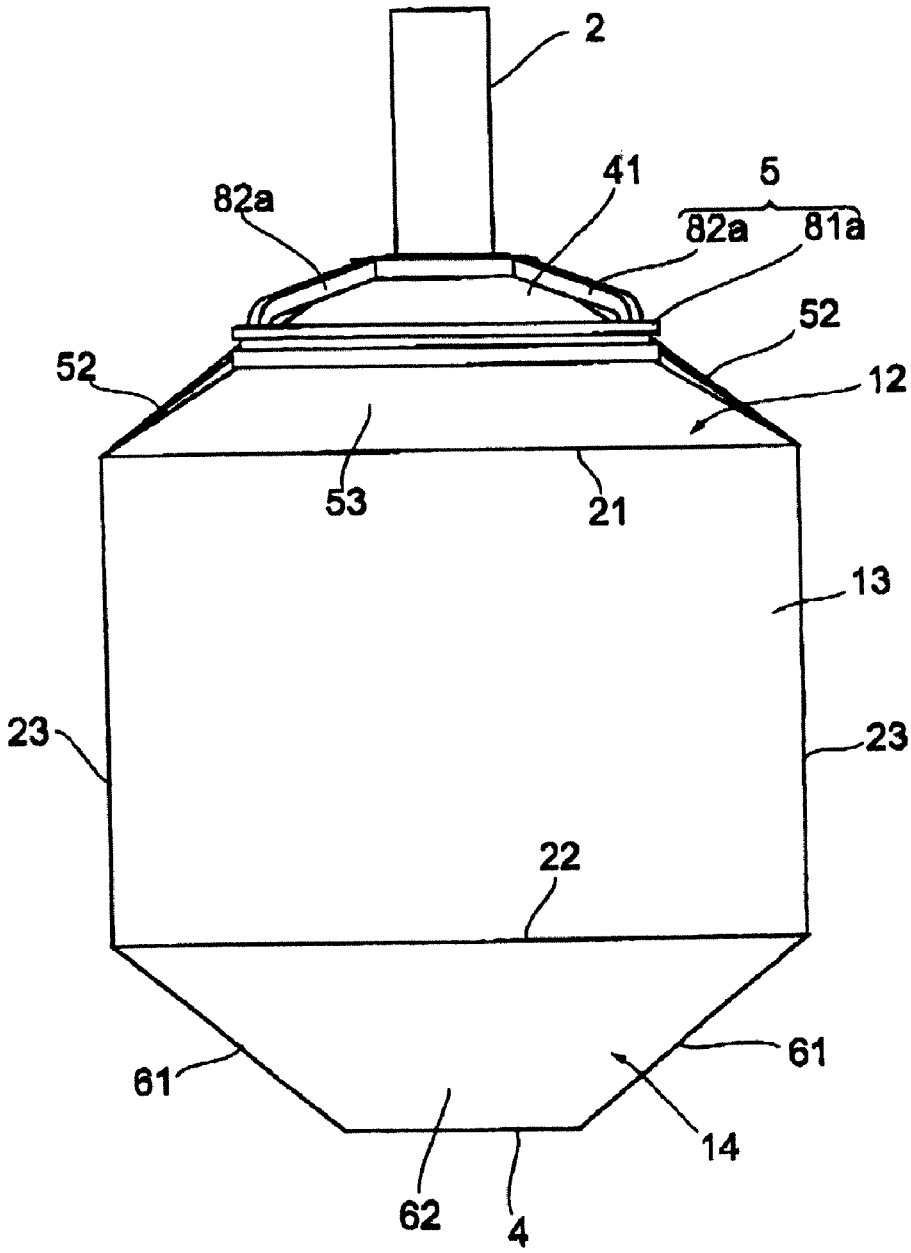
FIG. 9 depicts a front view of the plastic bottle of FIG. 8.
Figure 10:
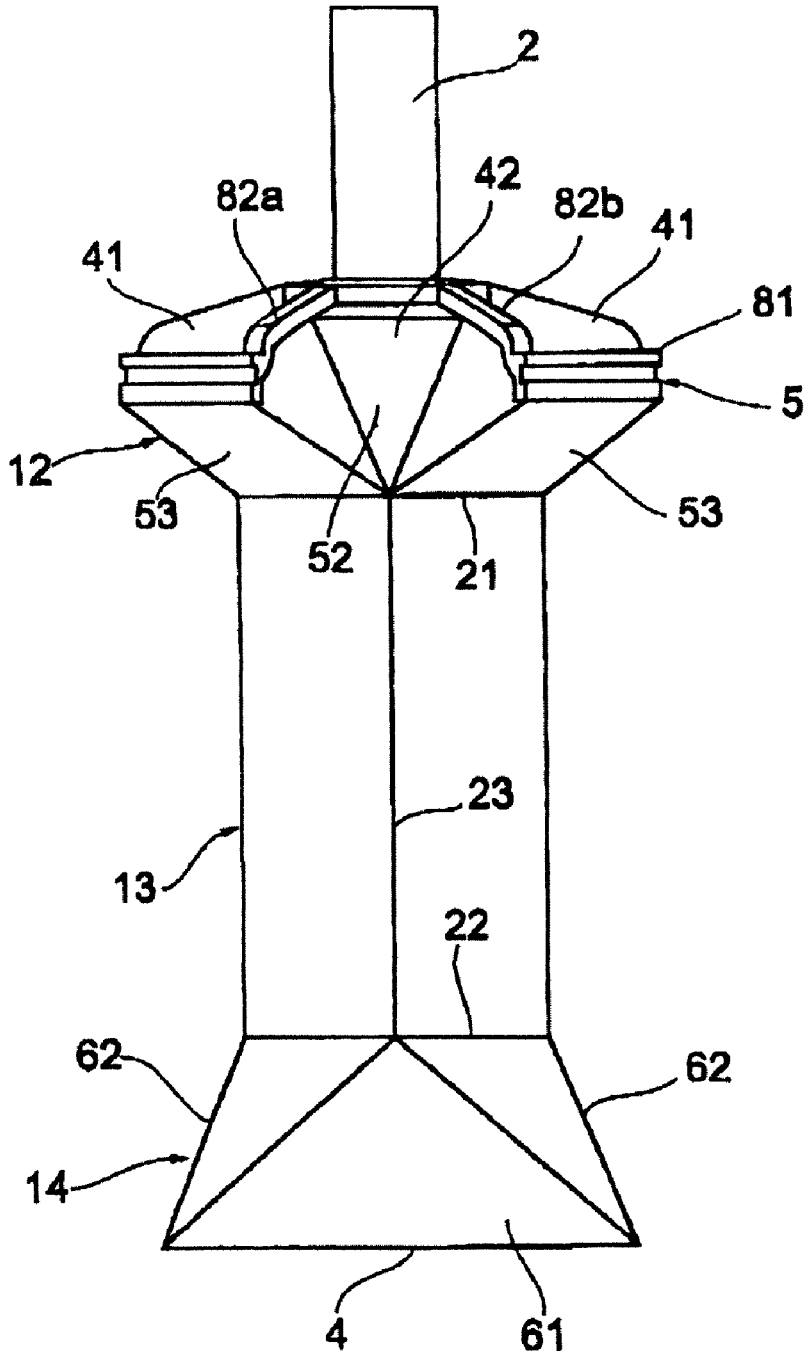
FIG. 10 depicts a side view from the transverse direction, shifted 90 degrees, of the plastic bottle of FIG. 9.
Figure 13:
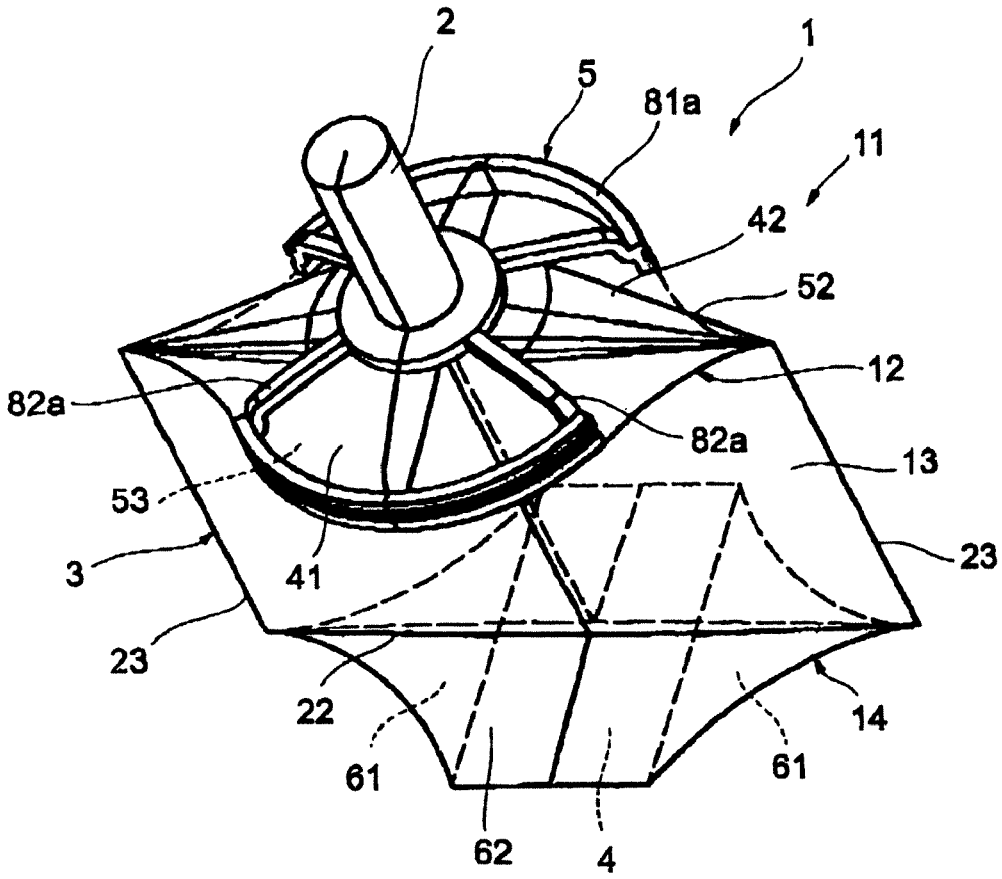
FIG. 13 depicts a perspective view of the plastic bottle of FIG. 1 after deformation.
Figure 14:
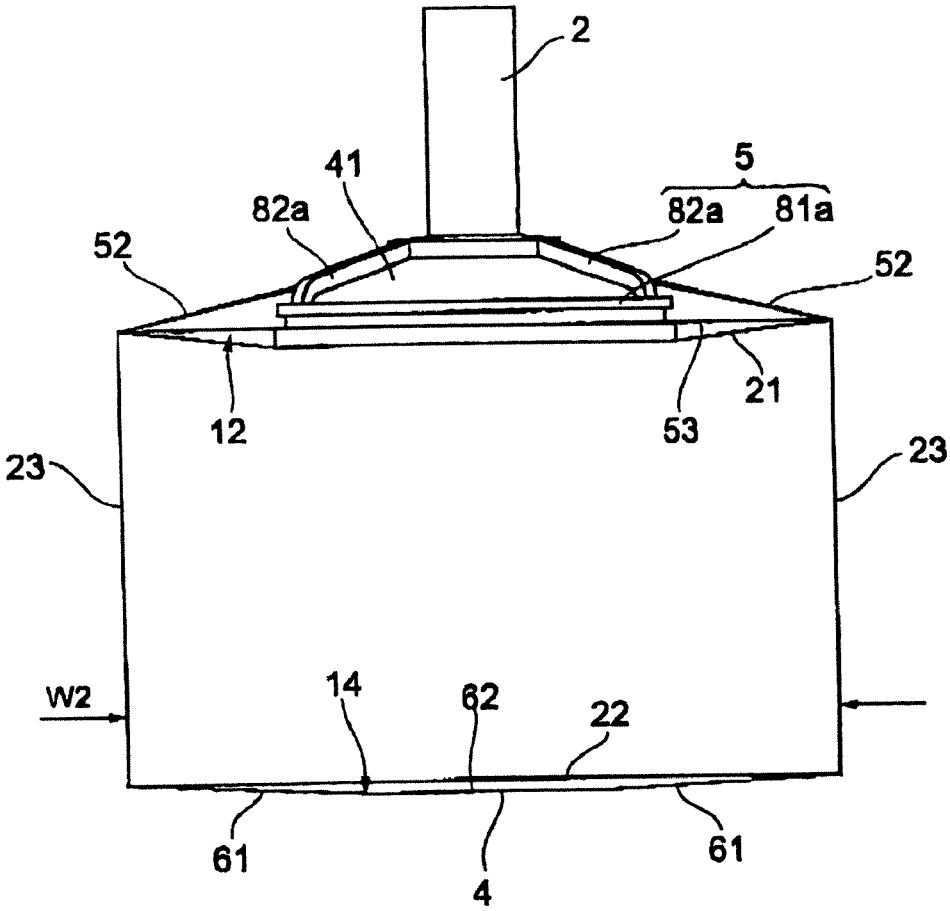
FIG. 14 depicts a front view of the plastic bottle of FIG. 13.
Figure 15:
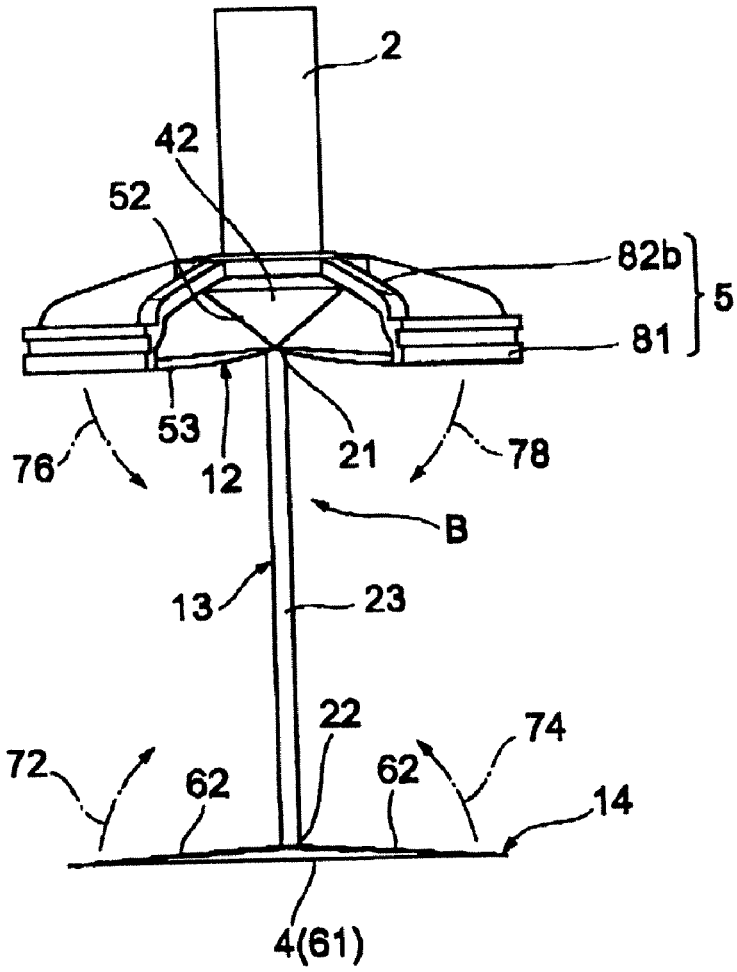
FIG. 15 depicts a side view from the transverse direction, shifted 90 degrees, of the plastic bottle of FIG. 14.
Figure 16:
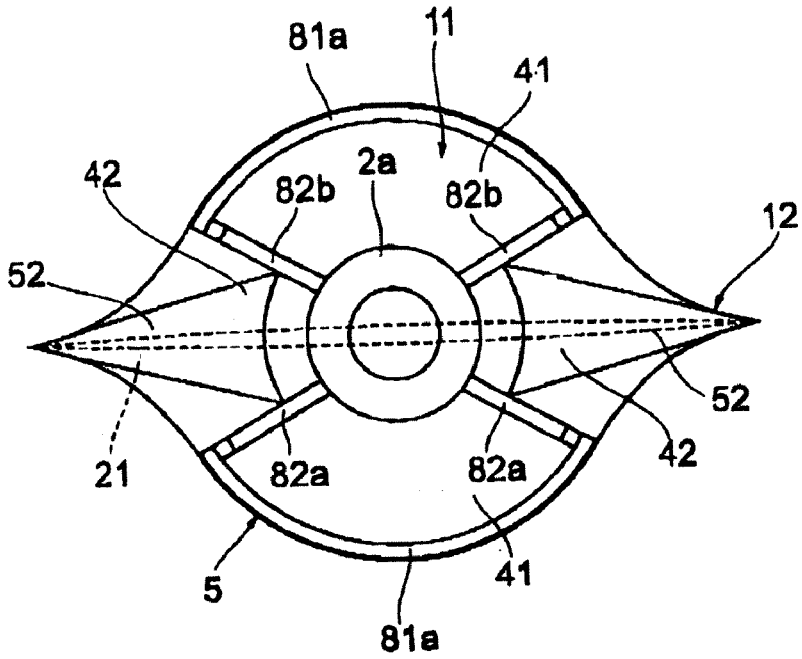
FIG. 16 depicts a top view of the plastic bottle of FIG. 14.
Figure 17:
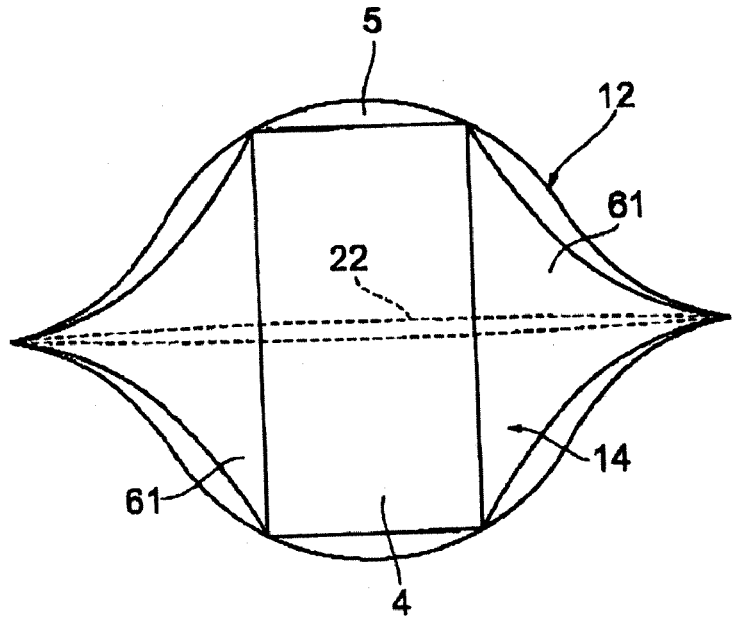
FIG. 17 depicts a bottom view of the plastic bottle of FIG. 14.

Main unit 3 is configured to deform from the state shown in FIGS. 1, 3, and 4 via the state shown in FIGS. 8-10 to the state shown in FIGS. 13-15. Central body section 13 deforms from a round cylindrical shape via an oval cylindrical shape, depicted in FIG. 8, to the substantially flat shape depicted in FIG. 15, when external force F is applied. As depicted in FIG. 4, external force F is applied to central body section 13 in a transverse direction. The two upper/lower edges of the substantially flat shape are formed via creases 21, 22, and the two left/right edges of the substantially flat shape are formed via the pair of creases 23, 23. Upper body section 12 and lower body section 14 deform so as to have substantially no height. The inner wall of upper body section 12 contacts the inner wall of shoulder 11, and the inner wall of lower body section 14 contacts the inner wall of base 4 when central body section 13 deforms into a substantially flat shape. As a result, main unit 3 undergoes volume reduction so as to present an I-beam profile overall with base 4, as shown in FIG. 15. During this series of main unit 3 deformations, rigid portion 5 does not prevent deformation of main unit 3.

Next, creases 21, 22, and 23 are described with reference to FIGS. 3-5, 14, and 15. The pair of creases 23, 23 mutually face and enclose the Y-Y central axis and extend parallel to the upward/downward directions, as shown in FIG. 3. Creases 23, 23 extend and the upper edge is directly below crease 21 while the lower edge is directly above crease 22, as shown in FIG. 4. Creases 23, 23 are formed in convex shape on the outer wall of central body section 13 and induce deformation to a substantially flat shape by outward folding from creases 23, 23. Central body section 13 is capable of deforming in a substantially flat shape until the opposing inner walls make mutual contact, as depicted in FIG. 15. Comparing FIG. 14 to FIG. 3, width W2 following deformation is wider than width W1 before deformation.

Creases 21 and 22 are formed in concave shape on the outer wall of main unit 3 and extend over roughly the entire circumference of main unit 3, as shown in FIGS. 3 and 4. However, creases 21 and 22 are discontinuous at sections above the elongation axis of creases 23, 23, as shown in FIG. 4. Thus, a total of four steps 31, two each in the vicinity of the discontinuous sections, are formed in crease 22. A total of four steps 32, two each in the vicinity of the discontinuous sections, are formed in crease 21. In another embodiment, creases 21, 22 can extend over the entire circumference of main unit 3 without any discontinuous sections. (Not shown.)

In addition, crease 21 has one traverse groove 33 with a frontal position shifted 90 degrees relative to crease 23, concave grooves 34, 34 continuous with both edges of traverse groove 33, and traverse grooves 35, 35 continuous with concave grooves 34, 34, as shown in FIG. 3. The structures of traverse groove 33, concave grooves 34, 34, and traverse grooves 35, 35 are also formed on the back side of crease 23. Concave groove 34 comprises a roughly isosceles triangle turned sideways. The apex of the isosceles triangle is continuous with one edge of traverse groove 33, and the center of the lower side of the isosceles triangle is continuous with one edge of traverse groove 35. Concave groove 34 is a deeper groove than traverse groove 33 and traverse groove 35. Consequently, steps are formed between concave groove 34 and traverse groove 33 as well as between concave groove 34 and traverse groove 35.

In this manner, steps (steps 31, 32, etc.) are attached to creases 21, 22, and the steps first bend so as to form a transverse cross-sectional shaped apex at creases 21, 22, followed by bending outward of the discontinuous section when external force F is applied. As a result, creases 21, 22 can bend in stages, and main unit 3 can more easily deform than a structure lacking steps. In an embodiment, crease 21 includes a plurality of step bends.

Furthermore, the application of external force F to the center of traverse groove 33 can form concave groove 34 having a different width and depth than traverse grooves 33 and 35. Continuous concave sections of creases 21, 22 are positioned on the surface of the side to which external force F is applied, while discontinuous sections of creases 21, 22 as well as convex creases 23, 23 are positioned on the surface of the side opposite from the surface to which external force F is applied. Central body section 13 can be induced to deform to a substantially flat shape due to the concave/convex spatial relationship.

Lower edge 12*a* of upper body section 12 and upper edge 13*a* of central body section 13 are slanted to the inside toward crease 21 in a lateral view as shown in FIG. 5. In addition, lower edge 13*b* of central body section 13 and upper edge 14*a* of lower body section 14 are slanted to the inside toward crease 22 in a lateral view. In such a structure, crease 21 and crease 22 collapse toward the inside when external force F centered on crease 21 and crease 22 is applied toward the inside. Therefore, those parts of upper body section 12, central body section 13, and lower body section 14 whose deformation to the inside is desired can be so induced. The lower edge of upper body section 12, the upper edge and lower edge of central body section 13, and the upper edge of lower body section 14 extend straight so as to smoothly link to creases 21, 22 in a front view, depicted in FIG. 3, that differs by 90 degrees from the view depicted in FIG. 5.

Figure 6:
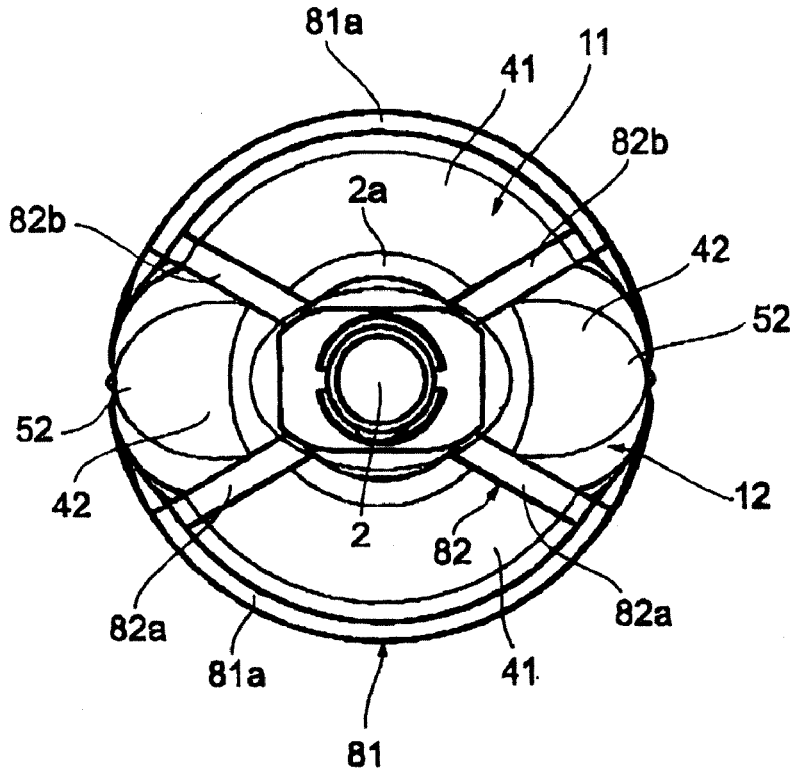
FIG. 6 depicts a top view of the plastic bottle of FIG. 3.

Next, shoulder 11 is described with reference to FIGS. 3, 4, and 6. Shoulder 11 includes a pair of fan sections 41, 41 having a fan shape in a top view, and a pair of cavities 42, 42 between a pair of fan sections 41, 41, as shown in FIGS. 3, 4, and 6. Cavity 42 is positioned lower than fan section 41. Cavity 42 is continuous with cavity 52 of upper body section 12 and is structured to form a inverted triangle in conjunction with cavity 52.

Next, upper body section 12 is described with reference to FIGS. 3, 4, 8, 11, and 13-15. Upper body section 12 includes a pair of cavities 52, 52 and a pair of flat sections 53, 53 disposed between a pair of cavities, as shown in FIGS. 3 and 4.

Figure 11:
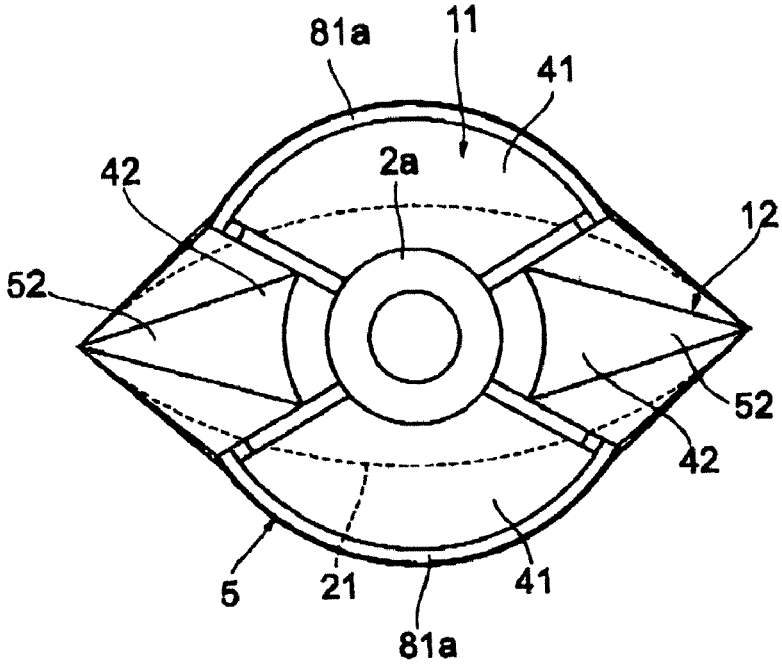
FIG. 11 depicts a top view of the plastic bottle of FIG. 9.
Figure 12:
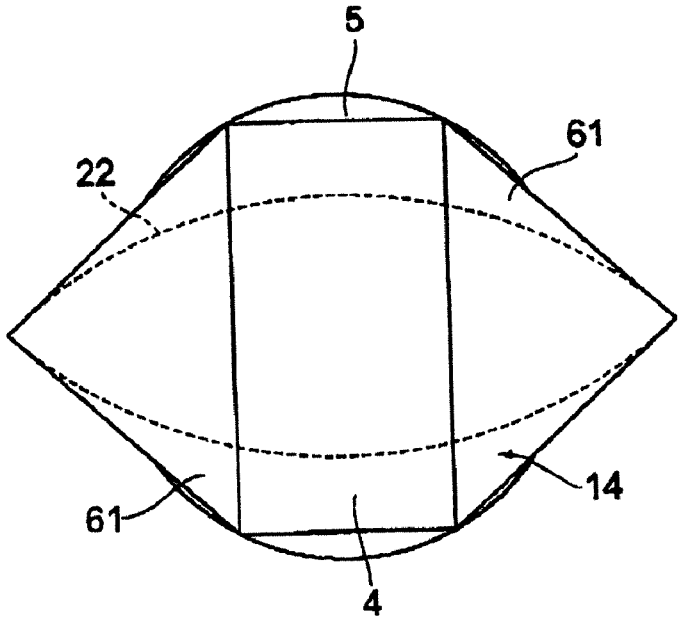
FIG. 12 depicts a bottom view of the plastic bottle of FIG. 9.

In the course of deformation of upper body section 12, flat section 53 collapses to the inside, and both edges of flat section 53 extend in the transverse direction, as shown in FIGS. 8 and 11. Furthermore, cavities 42, 52 extend in the transverse direction tracking deformation of flat section 53, their slopes become more moderate, and upper body section 12 folds. After upper body section 12 folds, a majority of flat section 53 overlaps fan section 41 from the bottom, and the inner walls of both make contact, as shown in FIGS. 13-15.

In this manner, in comparison to the pre-deformation shape, shoulder 11 and upper-body section 12 extend in the transverse direction after deformation, and the extended portions are absorbed by cavity 42 and cavity 52. In other words, the extended portions (length) of shoulder 11 and upper body section 12 that changed are released since cavity 42 and cavity 52 are formed in shoulder 11 and upper body section 12. By so doing, no strain develops on shoulder 11 and upper body section 12 following deformation.

Turning now to lower body section 14, lower body section 14 is a cylindrical circumferential wall that extends between base 4 and crease 22, as shown in FIGS. 3 and 4. Lower body section 14 includes a pair of first sections 61, 61 and a pair of second sections 62, 62, as shown in FIGS. 3, 4, and 7. First section 61 and second section 62 alternately continue in the circumferential direction.

In the course of deformation of lower body section 14, the top of first sections 61, 61 open to the outside while the top of second sections 62, 62 collapse to the inside, and the height of lower body section 14 falls, as shown in FIGS. 8-10 and 12.

Following deformation of lower body section 14, first sections 61, 61 are positioned on the same plane as base 4 and second sections 62, 62 overlap base 4 and first sections 61, 61 from above, as shown in FIGS. 13-15 and 17. In an explanation of this state focusing on the bottom of bottle 1, central body section 13 adopts a shape generally resembling an inverted T in a profile relative to lower body section 14 and base 4, as shown in FIG. 15. Crease 22 is positioned on a line of the intersection of two edges of this inverted T.

Following deformation as shown in FIG. 15, lower body section 14 can fold toward central body section 13 in the directions of arrows 72 or 74 centered on crease 22 in a mode integrated with base 4. Similarly, upper body section 12 can fold toward central body section 13 in the directions of arrows 76 or 78 centered on crease 21 in a mode integrated with shoulder 11. In this case, a portion, for example, up to half, of lower body section 14 can fold until it overlaps central body section 13, and a portion, for example, up to half, of upper body section 12 can fold until it overlaps central body section 13.

Next, rigid portion 5 is described in reference to FIGS. 3, 4, and 6. Rigid portion 5 is thicker than main unit 3 and its traverse strength and rigidity are greater than main unit 3. Rigid portion 5 comprises circumferential wall section 81 and connecting section 82 that connects circumferential wall section 81 with mouth 2.

Circumferential wall section 81 extends in the circumferential direction of main unit 3 so as to be discontinuous at two sections that mutually face and enclose the Y-Y central axis. In detail, circumferential wall section 81 comprises two arc sections 81*a*, 81*a*. The arc sections 81*a*, 81*a* have regions that mutually face and enclose the central axis at the most distant position from the Y-Y central axis in bottle 1. Specifically, the most distant sections of arc sections 81*a*, 81*a* from the Y-Y central axis form the greatest outer diameter of bottle 1.

Arc section 81*a* lies on the outside of the upper outer circumferential wall of main unit 3. In greater detail, it is positioned at step 90 between fan section 41 and flat section 53. The inner wall of arc section 81*a* makes planar contact with the outer wall of step 90. In addition, concave rib 84 is formed in the middle part of arc section 81*a* along the direction of extension (circumferential direction) to reinforce circumferential wall section 81.

Connecting section 82 comprises four strip shaped sections 82*a*, 82*a*, 82*b*, 82*b* that are positioned above shoulder 11. Two strip shaped sections 82*a*, 82*a* collaborate with one arc section 81*a* in cantilever support of arc section 81*a* in the planar view of FIG. 6. In detail, one edge of strip shaped sections 82*a*, 82*a* is connected to each edge of arc section 81*a* while the other edge is connected to lower edge 2*a* of mouth 2. The remaining two strip shaped sections 82*b*, 82*b* are identical in this regard.

The upper plane of strip shaped sections 82*a*, 82*a* match the upper plane of fan section 41 that is arranged between them. Similarly, the upper plane of strip shaped sections 82*b*, 82*b* matches the upper plane of fan section 41 that is arranged between them. In addition, cavity 42 between strip shaped section 82*a* and strip shaped section 82*b* faces them at a position lower than them.

In the structure of rigid portion 5, when bottle 1 is stacked horizontally in an vending machine, for example, rigid portions 5, 5 of bottles 1, 1 make mutual contact. Since rigid portion 5 has high traverse strength, as indicated above, plastic deformation would be inhibited even if a load were sustained from an adjacent bottle 1. Therefore, bottles 1 that are stacked maintain their shape. In particular, external force in the transverse direction sustained by circumferential wall section 81 could be released broadly to step 90 since circumferential wall section 81 makes planar contact with step 90. On the other hand, when main unit 3 undergoes deformation, the deformation would not be obstructed by rigid portion 5. In an embodiment, step 90 can separate from rigid portion 5 in the series of deformation steps. (Not shown.)

Figure 18:
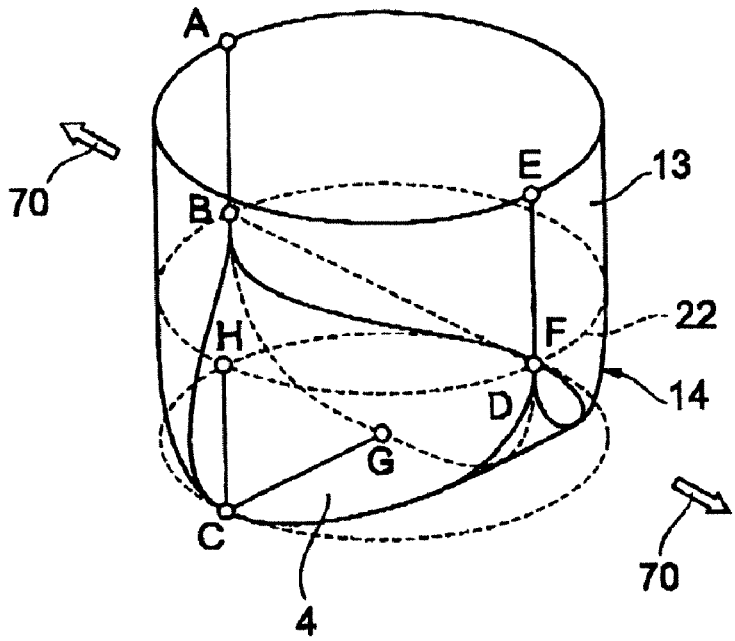
FIG. 18 depicts a schematic view of the lower portion of the plastic bottle before being folded.
Figure 19:
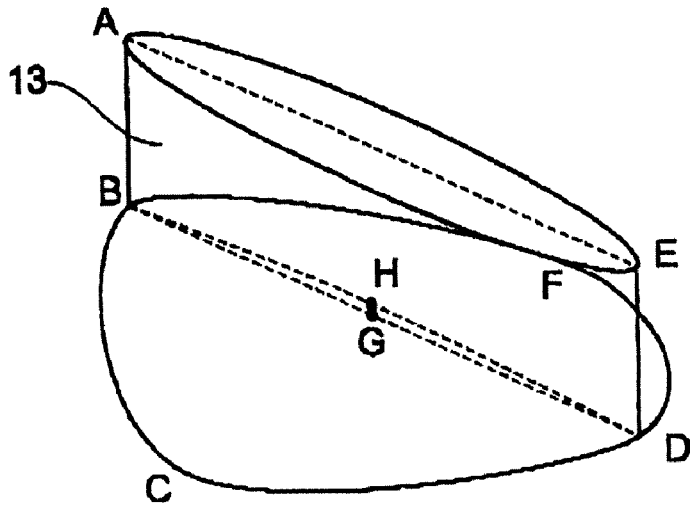
FIG. 19 depicts a schematic view of the lower portion of the plastic bottle of FIG. 18 after being folded.

Next, the folding of main unit 3 without bending base 4 is described with reference to FIGS. 18 and 19. FIGS. 18 and 19 are schematic views depicting the bottom of bottle 1. Point A and point E are positioned on central body section 13 mutually face and enclose the Y-Y central axis. Point B and point D that are positioned on crease 22 mutually face and enclose the Y-Y central axis. Finally, point A, point B, point D and point E are positioned on the same plane. Point H is positioned on crease 22 at the most distant position from point B and point D. Point G is the intersection point of base 4 and the Y-Y central axis. Point C and point F are on the line intersected by base 4 and the plane that includes point H and point G and are located at the most distant position from point G.

In such a spatial relationship, bottle 1 satisfies (a) to (c) below in the shape preceding deformation shown in FIG. 18:

arc BHD=curve BGD; (a)

curve BCD=curve BFD>curve BGD; and (b)

straight line CH=straight line CG. (c)

In addition, if (d) below is satisfied in the shape preceding deformation shown in FIG. 18, the width of central body section 13 that had assumed the substantially flat shape would be about equal to the widths of lower body section 14 and base 4.

arc AE=arc BHD (d)

Arc AE becomes a straight line, as shown in FIG. 19, when point B and point D open outward as indicated by arrow 70 in the shape shown in FIG. 18. At this deformation, curve BGD is drawn upward and point G on the plane that contains point B and point D shifts so that curve BGD becomes a straight line. Furthermore, point H shifts on the straight line that links point B and point D, with the result that arc BHD becomes a straight line parallel with arc AE. It is then positioned so as to overlap straight line BGD from above. Furthermore, straight line CH becomes positioned so as to overlap straight line CG from above. Lower body section 14 can be folded without bending of base 4 since the shape based on such principles is configured in lower body section 14 and base 4.

In yet another embodiment, the shape preceding deformations disclosed herein can also be configured in upper body section 12 and shoulder 11. By so doing, upper body section 12 can be folded without bending of shoulder 11. In this case, the shape for release of the length that changes during deformation (cavity 42 and cavity 52) must be formed in upper body section 12 and shoulder 11.

When dispensed, the product can be expelled from the retention space via mouth 2 by flattening main unit 3. In particular, creases 21, 22, 23 and sections of main unit 3 connected thereto are configured to induce deformation. Moreover, main unit 3 can be folded even without folding base 4, thereby enabling substantially the entire retention space of main unit 3 to be emptied. Thus, product located proximate to upper body section 12 and shoulder 11 and proximate to lower body section 14 and base 4 can be dispensed through mouth 2 by bending upper body section 12 and lower body section 14, as denoted by arrows 72, 74, 76, and 78 in FIG. 15.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A plastic bottle comprising:

a mouth;

a flexible main unit in fluid communication with said mouth, said main unit having a tubular body section;

a base forming a bottom of said main unit and configured to support the bottle to stand upright, said mouth, said main unit, and said base defining a retention space with a central axis of the plastic bottle; and a rigid portion located above said main unit and having greater strength in a direction perpendicular to the central axis of the plastic bottle than said main unit, said rigid portion having regions facing each other across from the central axis at the most distant position from the central axis, wherein the tubular body section is configured to deform to a deformation state comprising a substantially flat shape without said rigid portion undergoing plastic deformation when an external force is applied in a direction perpendicular to the central axis of the plastic bottle; and wherein said rigid portion has a circumferential wall section outside of an upper wall of said main unit, and a connecting section above the upper wall, the connecting section connecting the circumferential wall section with the said mouth.

2. The plastic bottle according to claim 1, wherein the circumferential wall section has an inner wall contacting an outer wall of the upper wall of said main unit.

3. The plastic bottle according to claim 1, wherein the connecting section connects in a strip shape with said mouth and at least two locations of the circumferential wall section.

4. The plastic bottle according to claim 1, wherein the circumferential wall section comprises at least two discontinuous sections extending in the circumferential direction and four edges, the at least two discontinuous sections facing each other with the central axis interposing the sections, the four edges connecting to said mouth by the connecting section.

5. The plastic bottle according to claim 1, wherein the circumferential wall section comprises at least one concave rib formed along the elongate direction.

6. The plastic bottle according to claim 1, wherein the rigidity of said base is greater than the rigidity of said main unit.

7. The plastic bottle according to claim 1, wherein said main unit comprises:

an upper body section having an inner wall extending upward from the tubular body section, a tapered shoulder connecting the upper body section with said mouth, and at least one step between the upper body section and the shoulder, wherein the circumferential wall section is positioned at the at least one step, and the connecting section is positioned at the uppermost portion of the shoulder.

8. The plastic bottle according to claim 7, wherein the upper body section is configured to contact an inner wall of the shoulder when the tubular body section is in the deformation state.

9. The plastic bottle according to claim 8, wherein the upper body section and the shoulder have a shape to release the length that changes during deformation at a position away from the steps.

10. The plastic bottle according to claim 9, further comprising a concave crease disposed between the upper body section and the tubular body section.

11. The plastic bottle according to claim 10, wherein at least part of the lower edge of the upper body section and at least part of the upper edge of the tubular body section slope inward toward the crease.

12. The plastic bottle according to claim 7, wherein said main unit comprises a lower body section connecting the tubular body section and the base, and the lower body section configured to deform differently than the tubular body section.

13. The plastic bottle according to claim 7, wherein the tubular body section comprises a pair of second creases that mutually face and enclose the central axis, and the pair of second creases comprise two upper and lower parallel edges in the flat shape.

14. The plastic bottle according to claim 13, wherein the pair of second creases are formed in convex shapes configured to induce the tubular body section to fold outward in the deformation state.

15. The plastic bottle according to claim 1, wherein the deformation of the tubular body section is plastic deformation.

16. The plastic bottle according to claim 1, wherein said mouth, said main unit, said base, and said rigid portion are integrally molded.

17. The plastic bottle according to claim 16, wherein said mouth, said main unit, said base, and said rigid portion are injection stretch blow molded.

18. The plastic bottle according to claim 1, further comprising a jelly beverage contained within at least a portion of said main unit.

* * * * *